US008925853B2

(12) United States Patent
Mellin

(10) Patent No.: US 8,925,853 B2
(45) **Date of Patent: *Jan. 6, 2015**

(54) MANDREL CUPPING ASSEMBLY

(75) Inventor: André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 281 days.

This patent is subject to a terminal disclaimer.

(21) Appl. No.: 13/595,361

(22) Filed: Aug. 27, 2012

(65) Prior Publication Data

US 2014/0054409 A1 Feb. 27, 2014

(51) Int. Cl.

| | |
|---|---|
| ***B65H 19/00*** | (2006.01) |
| ***B65H 67/00*** | (2006.01) |
| ***B65H 18/02*** | (2006.01) |
| ***B65H 19/22*** | (2006.01) |

(52) U.S. Cl.

CPC ..... *B65H 18/021* (2013.01); *B65H 19/2223* (2013.01); *B65H 2301/41362* (2013.01); *B65H 2402/352* (2013.01); *B65H 2404/61* (2013.01); *B65H 2404/69* (2013.01)

USPC ..... 242/559.2; 242/533.4; 242/533.5

(58) Field of Classification Search

USPC ..... 242/533.2, 533.4, 533.5, 533.6, 559.1, 242/559.2

See application file for complete search history.

(56) References Cited

U.S. PATENT DOCUMENTS

| | | | | |
|---|---|---|---|---|
| 376,641 | A * | 1/1888 | Dille | 83/436.55 |
| 1,732,740 | A * | 10/1929 | Cline | 242/559.2 |
| 1,902,826 | A * | 3/1933 | Bobo | 242/532.5 |
| 2,671,495 | A * | 3/1954 | Iredell et al. | 156/361 |
| 2,769,600 | A * | 11/1956 | Ernst et al. | 242/530.1 |
| 2,783,000 | A * | 2/1957 | Gredigk et al. | 242/419.3 |
| 3,204,887 | A * | 9/1965 | Hansen et al. | 242/559.2 |
| 3,381,911 | A * | 5/1968 | Held et al. | 242/527.3 |
| 3,411,732 | A * | 11/1968 | Ebneter | 242/527.2 |

(Continued)

FOREIGN PATENT DOCUMENTS

| | | |
|---|---|---|
| DE | 2263264 A1 | 6/1974 |
| DE | 3041030 C2 | 6/1987 |

(Continued)

OTHER PUBLICATIONS

PCT International Search Report, mailed Nov. 7, 2013, 155 pages.

(Continued)

*Primary Examiner* — Emmanuel M Marcelo
*Assistant Examiner* — Michael Gallion
(74) *Attorney, Agent, or Firm* — Peter D. Meyer

(57) ABSTRACT

A mandrel cupping assembly for releasably engaging the unsupported ends of a plurality of mandrels disposed on a web winding turret assembly is disclosed. The mandrel cupping assembly comprises a cupping arm turret, a mandrel cup and cupping arm cooperatively associated with each mandrel, an outer ring guide disposed coaxially about the cupping arm turret, and an actuator cooperatively associated with each cupping arm. Each of the mandrel cups and cupping arms are disposed radially about the cupping arm turret. The mandrel cups releasably engage the unsupported end of the mandrel against the outer ring guide. The mandrel cups have a hold-open position and a hold-closed position and are carried in a radial orbital path about the cupping arm turret while disposed in either of the hold-open position or the hold-closed position. Each actuator disposes the corresponding cupping arm from the hold-open position to the hold-closed position.

16 Claims, 6 Drawing Sheets

(56) References Cited

U.S. PATENT DOCUMENTS

| | | | | | |
|---|---|---|---|---|---|
| 3,430,881 | A | * | 3/1969 | Ebneter | 242/527.2 |
| 3,472,462 | A | | 10/1969 | Young | |
| 3,540,669 | A | * | 11/1970 | Schmidt et al. | 242/417.3 |
| 3,552,670 | A | * | 1/1971 | Herman | 242/527.1 |
| 3,761,032 | A | | 9/1973 | Bahnsen | |
| 4,266,735 | A | | 5/1981 | Leanna et al. | |
| 4,280,669 | A | | 7/1981 | Leanna et al. | |
| 4,327,876 | A | * | 5/1982 | Kuhn | 242/527.4 |
| 4,456,190 | A | * | 6/1984 | Karttunen et al. | 242/527.3 |
| 4,466,577 | A | * | 8/1984 | Heinz et al. | 242/559.2 |
| 4,516,742 | A | * | 5/1985 | Townsend | 242/533.5 |
| 4,588,138 | A | * | 5/1986 | Spencer | 242/533.6 |
| 4,635,871 | A | | 1/1987 | Johnson et al. | |
| 4,993,652 | A | * | 2/1991 | Moeller | 242/527.3 |
| 5,417,382 | A | | 5/1995 | Petitjean et al. | |
| 5,435,501 | A | | 7/1995 | Alexander et al. | |
| 5,544,828 | A | * | 8/1996 | Winkler et al. | 242/473.5 |
| 5,645,240 | A | * | 7/1997 | Signoretto | 242/332.4 |
| 5,667,162 | A | * | 9/1997 | McNeil et al. | 242/533.4 |
| 5,690,297 | A | * | 11/1997 | McNeil et al. | 242/533.4 |
| 5,725,176 | A | * | 3/1998 | Vigneau | 242/521 |
| 5,732,901 | A | | 3/1998 | McNeil et al. | |
| 5,743,482 | A | * | 4/1998 | Suzuki et al. | 242/533.4 |
| 5,845,867 | A | | 12/1998 | Hould et al. | |
| 5,851,345 | A | * | 12/1998 | Semba | 156/510 |
| 6,113,287 | A | * | 9/2000 | Merz et al. | 396/515 |
| 6,129,304 | A | | 10/2000 | Biagiotti | |
| 6,354,530 | B1 | * | 3/2002 | Byrne et al. | 242/533.5 |
| 6,595,459 | B2 | | 7/2003 | Hanson | |
| 7,124,979 | B2 | * | 10/2006 | Pasquale | 242/533.4 |
| 7,204,448 | B2 | * | 4/2007 | Heikaus | 242/533.4 |
| 7,536,763 | B2 | | 5/2009 | Offerhaus | |
| 8,042,761 | B2 | | 10/2011 | Wojcik et al. | |
| 8,096,494 | B2 | | 1/2012 | Simonelli et al. | |
| D683,615 | S | * | 6/2013 | Noumi et al. | D8/356 |
| 2005/0077416 | A1 | * | 4/2005 | Heikaus | 242/533.4 |
| 2006/0137501 | A1 | * | 6/2006 | Damo | 83/277 |
| 2007/0278342 | A1 | | 12/2007 | Harkins | |
| 2010/0320307 | A1 | | 12/2010 | Pappas et al. | |
| 2013/0092782 | A1 | * | 4/2013 | Day et al. | 242/533.4 |
| 2013/0092783 | A1 | * | 4/2013 | Day et al. | 242/533.4 |
| 2013/0277490 | A1 | * | 10/2013 | Meyer | 242/533.4 |

FOREIGN PATENT DOCUMENTS

| | | | |
|---|---|---|---|
| EP | 0145029 | A2 | 6/1985 |
| EP | 0313859 | A2 | 5/1989 |
| GB | 1218709 | A | 1/1971 |

OTHER PUBLICATIONS

U.S. Appl. No. 13/449,377, filed Apr. 18, 2012, Meyer.
U.S. Appl. No. 13/449,382, filed Apr. 18, 2012, Meyer.
U.S. Appl. No. 13/272,303, filed Oct. 13, 2011, Lockwood, et al.
U.S. Appl. No. 13/272,310, filed Oct. 13, 2011, Lockwood, et al.
U.S. Appl. No. 13/272,312, filed Oct. 13, 2011, Lockwood, et al.
U.S. Appl. No. 13/568,591, filed Aug. 7, 2012, Singer, et al.
U.S. Appl. No. 13/568,539, filed Aug. 7, 2012, Singer, et al.
U.S. Appl. No. 13/568,675, filed Aug. 7, 2012, Singer, et al.
U.S. Appl. No. 13/568,711, filed Aug. 7, 2012, Singer, et al.
U.S. Appl. No. 13/595,326, filed Aug. 27, 2012, Mellin.

* cited by examiner

MANDREL CUPPING ASSEMBLY

FIELD OF THE INVENTION

The present disclosure relates to automatic web rewinding machines where paper towel stock, bath tissue stock, or the like unwound from very large parent rolls is rewound into small individual rolls. In particular, the present disclosure relates to an apparatus that releasably attaches a mandrel cup into and out of supporting engagement with the free end of a mandrel prior to the winding of the web material upon the mandrel and subsequently detaching the mandrel cup from the mandrel so that the wound web material can be removed from the mandrel to for additional processing.

BACKGROUND OF THE INVENTION

Typical web rewinding machines provide a number of core supporting mandrels ranging anywhere from four to ten in number which are mounted on an indexingly rotatable turret. The mandrels extend parallel to the horizontal axis about which the turret rotates, and they are spaced at equal distances from the turret axis and at uniform intervals around that axis. By way of example, a typical six-mandrel turret moves through one-sixth of a revolution at each of its indexing movements and hence it carries each mandrel in turn to each of the six successive stations with a period of dwell at each station. By way of yet another example, an exemplary eight-mandrel turret moves through one-eighth of a revolution at each of its indexing movements and hence it carries each mandrel in turn to each of the eight successive stations with a period of dwell at each station. In any regard, it should be understood that the number of spindles disposed about any given turret used in a web rewinding machine would likely determine the number of successive stations in any such device.

In such a configuration, typically one station (sometimes called a first station) is a loading station at which a length of core stock is slid axially onto the mandrel. At the next station, the core stock has an adhesive or glue applied to the surface of the core. At the third station, the mandrel is brought up to winding speed. As the mandrel moves from the third to the fourth station, the web material is attached to the glued core disposed upon the mandrel for the beginning of the winding operation. Winding continues while the mandrel is at the fourth station. As the mandrel moves out of the fourth station, the web material is cut through across its width (or cross-machine direction) to sever it from the wound roll of web material (e.g., the source of the web material) and give it a new leading edge that is attached to a new core on the next mandrel moving into the winding station. At the fifth station, the rotation of the mandrel is decelerated to a stop, and at the sixth station a wound core or log is stripped off the mandrel. The mandrel then moves to the first station for a repetition of the cycle.

A conventional turret by which the mandrels are carried comprises a spider which is mounted for a rotation on a coaxial shaft that projects a substantial distance in one direction from the spider. The mandrels have rotating connections with the spider, and they project from it in the same direction as the turret shaft. The rotating connection of each mandrel with the spider must provide cantilevered support of the mandrel because when the mandrel is at the core loading station and the unloading station, the end of the mandrel that is remote from the spider to has to be accessible to allow cores to be moved axially onto and off. It should be recognized that the mandrels tend to be heavy and very long—typically, 72 inches to 96 inches in length. Therefore, their free ends are typically supported whenever possible and certainly during winding.

To provide support of the free ends of the mandrels, there is conventionally an assembly of supporting arms or chucks on the end portion of the turret shaft that is remote from the spider. This is also known to those in the art as a mandrel cupping assembly. A mandrel cupping assembly is an assembly that is constrained to indexing rotation concurrent with the spider containing the individual mandrels. The mandrel cupping spider generally comprises a chuck arm (or cup) cooperatively associated with each mandrel. Each chuck arm is generally swingable about an axis which is near the turret axis and transverse thereto between a substantially radially extending closed position in which the free end of the chuck arm supportingly engages the free end portion of its associated mandrel and an open position in which the chuck arm is disengaged from its mandrel and is disposed in a more or less axial orientation alongside the turret shaft. Each chuck arm is operated automatically so that it is in its open position during loading and unloading of the mandrel and is in its closed position at least from the time the mandrel moves into the gluing station and moves out of the deceleration station mentioned supra.

In one embodiment, a conventional mechanism for actuating the mandrel supporting chuck arms is provided with a barrel cam that is fixed to the machine frame adjacent to the free ends of the mandrels and a lever and link arrangement for each chuck arm. Each arrangement is carried by the turret for rotation therewith and having a cam follower roller that rides in a groove in the periphery of the stationary barrel cam. Each chuck arm is actuated at appropriate times in consequence of indexing movement of the turret. The shape of the cam groove is provided so that the chuck arms move into engagement with their respective mandrels when the latter are generally adjacent the glue applicator wheels and retract when the mandrels move from the web material winding position.

In such an operation, the stripping of wound rolls off a mandrel is conventionally accomplished by means of a pusher that engages the log at only one side of the mandrel and provides a lateral force upon the cantilevered mandrel. This can set the mandrel into a vibration mode that may be aggravated by the indexing movement that follows unloading. With the mandrel unsupported at the loading station, its free end often wobbles so severely that the core may not be run onto it with automatic core loading equipment. Such an apparatus is described in U.S. Pat. No. 2,769,600.

It is believed that with such conventional machines, the failure to load a core creates a danger that the mandrel itself would be coated with glue at the gluing station necessitating a lengthy shutdown of the machine for cleaning. An operator, seeing that such an unloaded core was moving out of the unloading station, would be required to stop the machine and would find that there is no way to retract the chuck arm engaged with the empty mandrel to permit manual axial unloading of the core. This is because of the nature of the chuck arm actuating mechanism. One purported solution to this problem was to slit a core along its length and push it laterally onto a mandrel to protect the mandrel from glue. At the conclusion of the winding cycle the individual rolls wound onto the slitted core are then discarded.

It is also believed that wobble of an unsupported mandrel could cause a chuck arm to fail to engage the mandrel properly. One solution proposed was a U-shaped member on each chuck arm that tended to preliminarily engage the mandrel during closing movement of the chuck arm and steady the mandrel sufficiently to enable its conical free end to be received in the bearing socket disposed in the chuck arm. However, it is believed that this expedient is not always successful in practice because as the wobbling mandrel fails to enter the chuck arm socket, the chuck arm mechanism exerts as much force as the indexing mechanism can provide. This can result in the inevitable bending or breakage of the link and lever elements that translate any cam follower motion into swinging motion of the chuck arm. The repair of such damage would be necessarily difficult and time consuming.

It is also believed that another expedient that has been used to prevent damage to the chuck arm actuating mechanism is to mount the barrel cam for limited axial motion and pneumatically bias it towards one limit of such motion. When a chuck arm fails to close properly, the reaction force that is imposed upon the cam moves it against its bias to a position which actuates an emergency stop. However, it is believed that such an emergency shutdown arrangement merely relieves some of the effects of the problem rather than solving the problem itself. By way of example, it will not permit axial loading of a core onto an empty mandrel that had moved out of the loading position.

Other solutions provide an automatic web rewinding machine or an automatic mandrel chucking mechanism that does not employ force derived from the turret indexing to affect chuck arm actuation. The chuck arms move to and from their mandrel supporting positions only during periods of dwell to minimize the likelihood of mandrel vibration at the time chuck arm closing occurs. The mechanism is arranged to allow a chuck arm to be manually controlled for movement to its open position in any position of the turret so that a core can be axially loaded to onto an empty mandrel or a defective core or roll can be axially stripped off the mandrel. Such a system is described in U.S. Pat. No. 4,266,735.

In any regard, attempts by the prior art to achieve an automatic web rewinding machines all provide for a single chuck arm and it associated equipment to be cooperatively associated with a respective mandrel. Further, the chuck arm and its associated equipment must cooperatively rotate with the mandrel about the turret axis. In other words, a chuck arm is constrained to rotate with the turret and is movable relative to and between a closed position (in which the chuck arm supportingly engages the other end of the mandrel) and an open position (in which the chuck arm is disengaged from the mandrel) to permit cores to be moved axially onto and off it. Clearly, the mechanism is unduly complex and requires numerous moving parts and associated ancillary equipment for it to perform its intended function.

Thus, it would be clearly advantageous to provide a turret system and in particular, a mandrel cupping assembly that is less complex and requires fewer moving parts to perform its intended function. In fact, such system would rotate only the mandrel cup with its respective mandrel free of any associated equipment necessary to load and unload the mandrel cup. Clearly, such systems would be appreciated by one of skill in the art because of their overall simplicity and ease of use.

SUMMARY OF THE INVENTION

The present disclosure provides for a mandrel cupping assembly for releasably engaging the unsupported ends of a plurality of mandrels disposed on a web winding turret assembly. The mandrel cupping assembly comprises a cupping arm turret, a mandrel cup and cupping arm cooperatively associated with each mandrel, an outer ring guide disposed coaxially about the cupping arm turret, and an actuator cooperatively associated with each of the cupping arms. Each of the mandrel cups and cupping arms are disposed radially about the cupping arm turret. The mandrel cups releasably engage the unsupported end of the mandrel against the outer ring guide. The mandrel cups have a hold-open position and a hold-closed position and are carried in a radial orbital path about the cupping arm turret while disposed in either of the hold-open position or the hold-closed position. Each of the actuators disposes the cupping arm cooperatively associated thereto from the hold-open position to the hold-closed position.

DETAILED DESCRIPTION OF THE INVENTION

Figure 1:
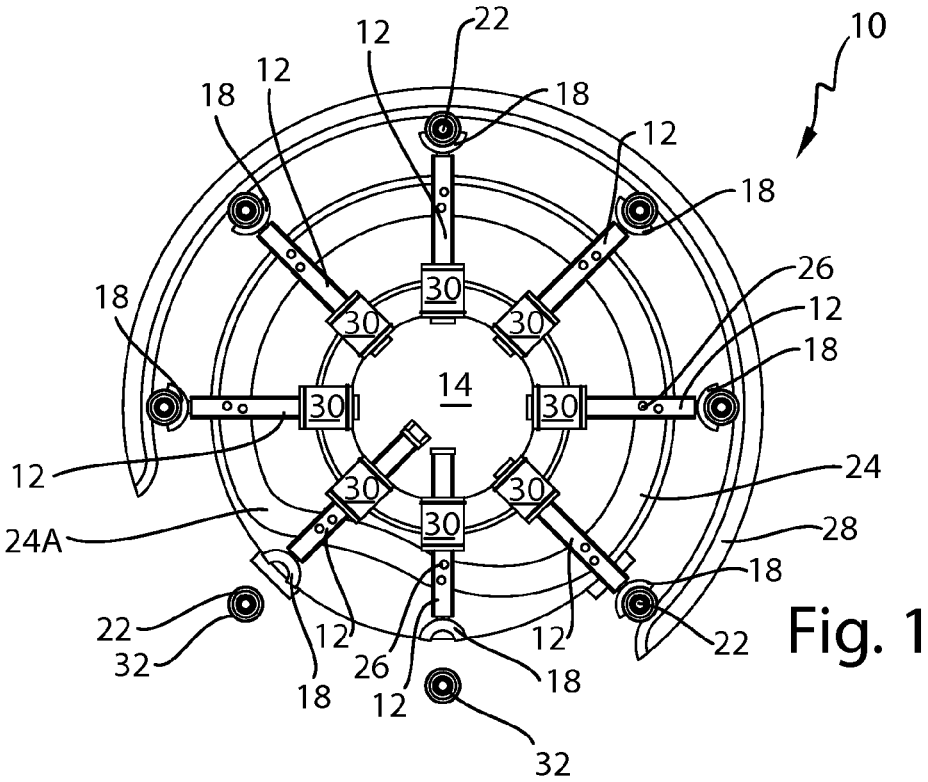
FIG. 1 is a planar end view of an exemplary mandrel cupping assembly of the present disclosure detailing both the open and closed positions.
Figure 2:
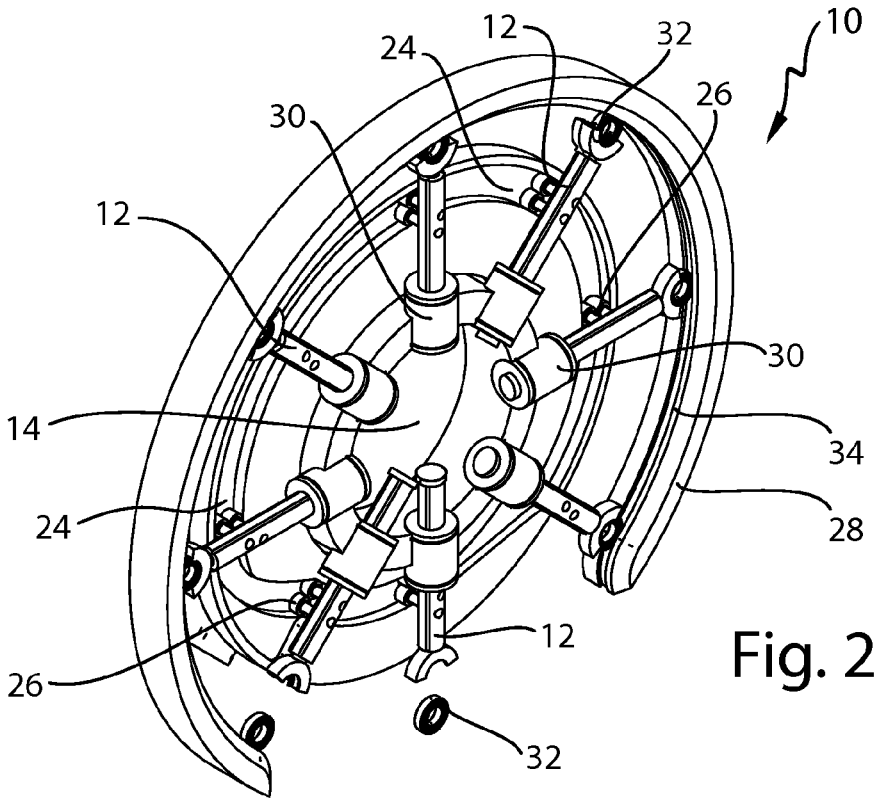
FIG. 2 is a perspective view of the exemplary mandrel cupping assembly of FIG. 1.
Figure 3:
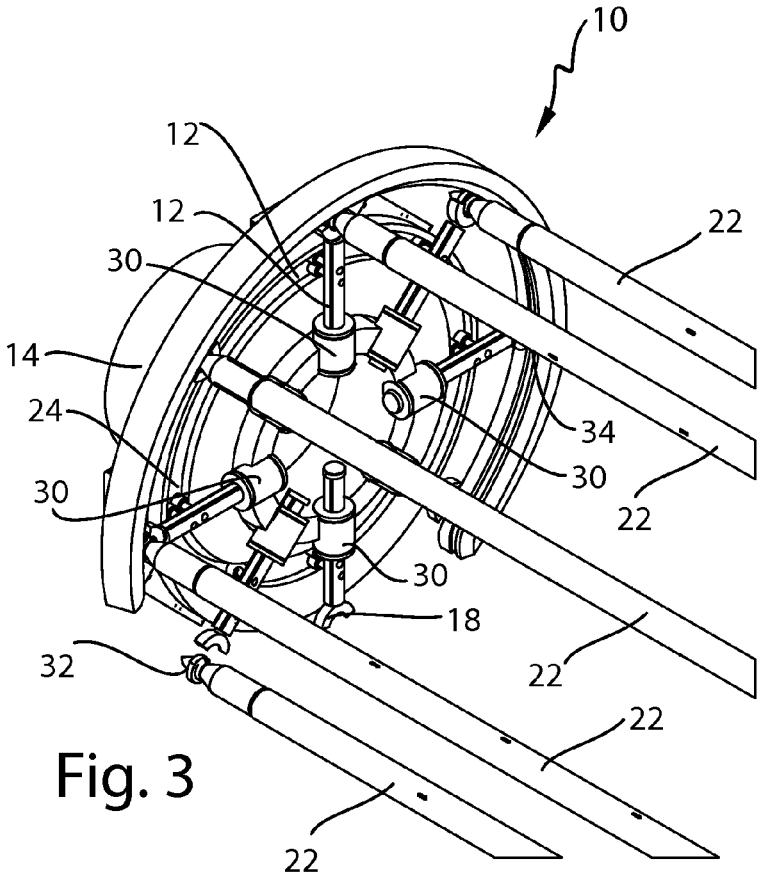
FIG. 3 is an alternative perspective view of the left side of the exemplary mandrel cupping assembly of FIG. 1 showing mandrels cooperatively associated with mandrel cups.
Figure 4:
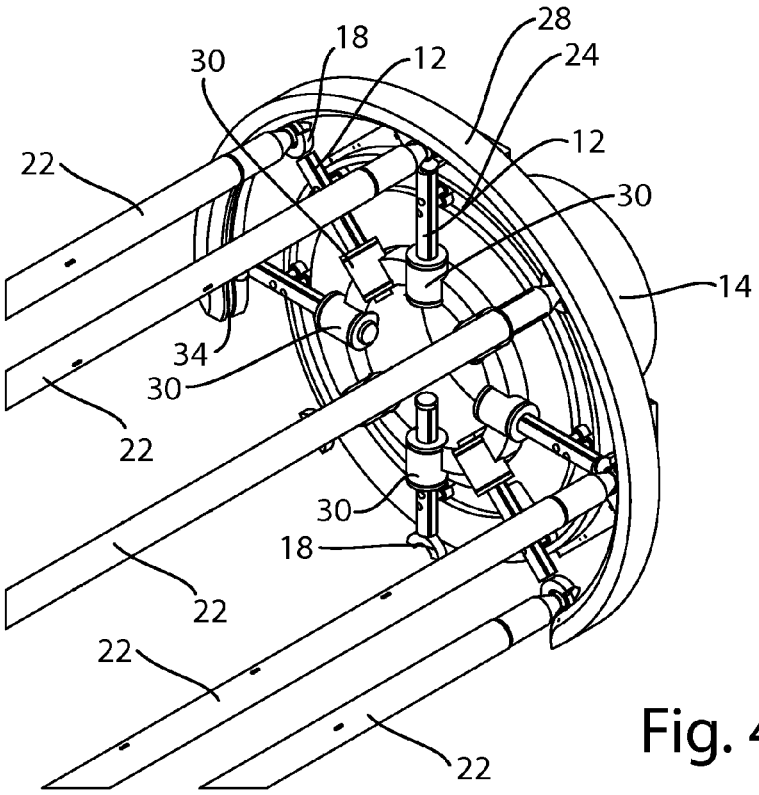
FIG. 4 is yet another alternative perspective view of the right side of the exemplary mandrel cupping assembly of FIG. 1 showing mandrels cooperatively associated with mandrel cups.
Figure 5:
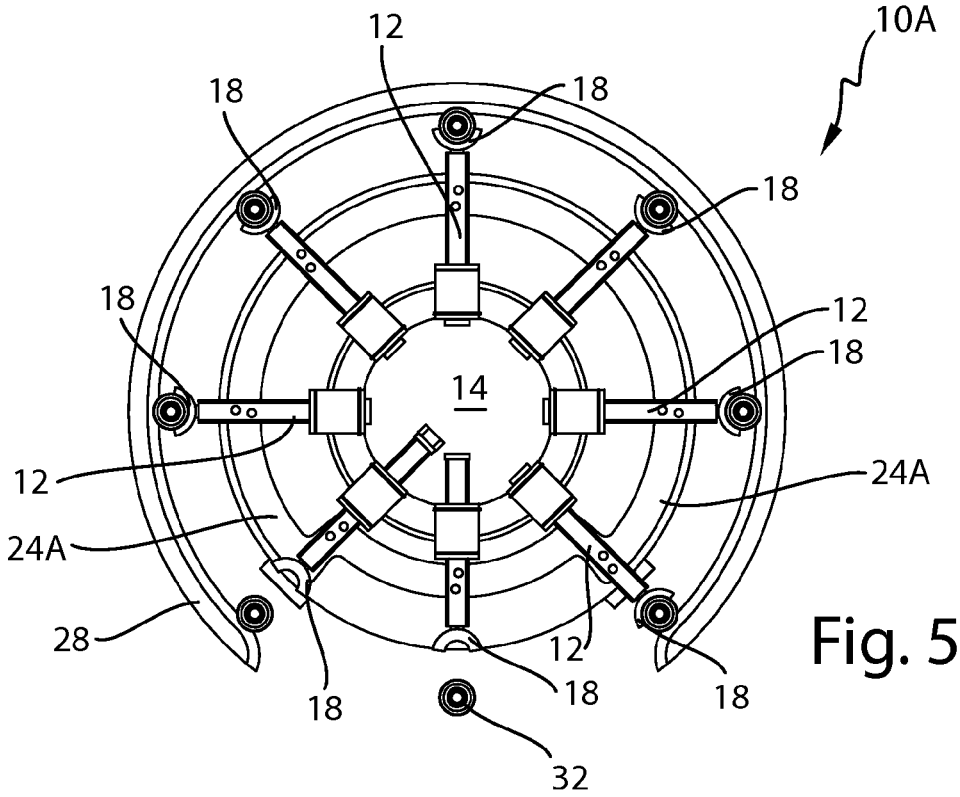
FIG. 5 is a planar end view of another exemplary mandrel cupping assembly of the present disclosure detailing both the open and closed positions.
Figure 6:
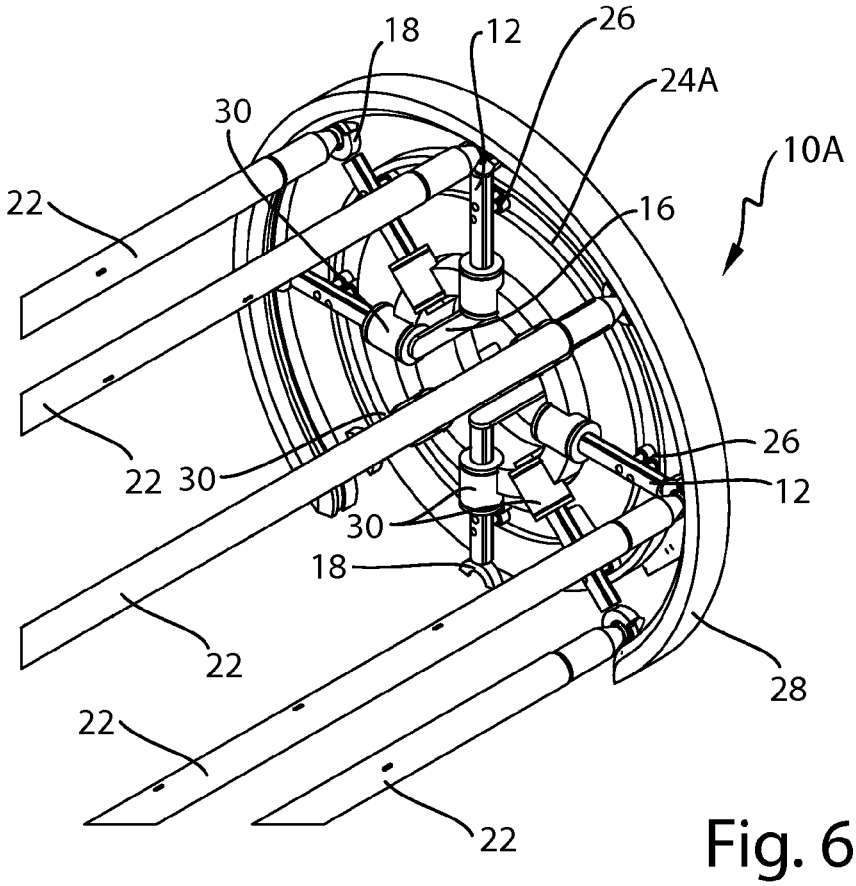
FIG. 6 is a perspective view of the right side of the exemplary mandrel cupping assembly of FIG. 5 showing mandrels cooperatively associated with mandrel cups.
Figure 7:
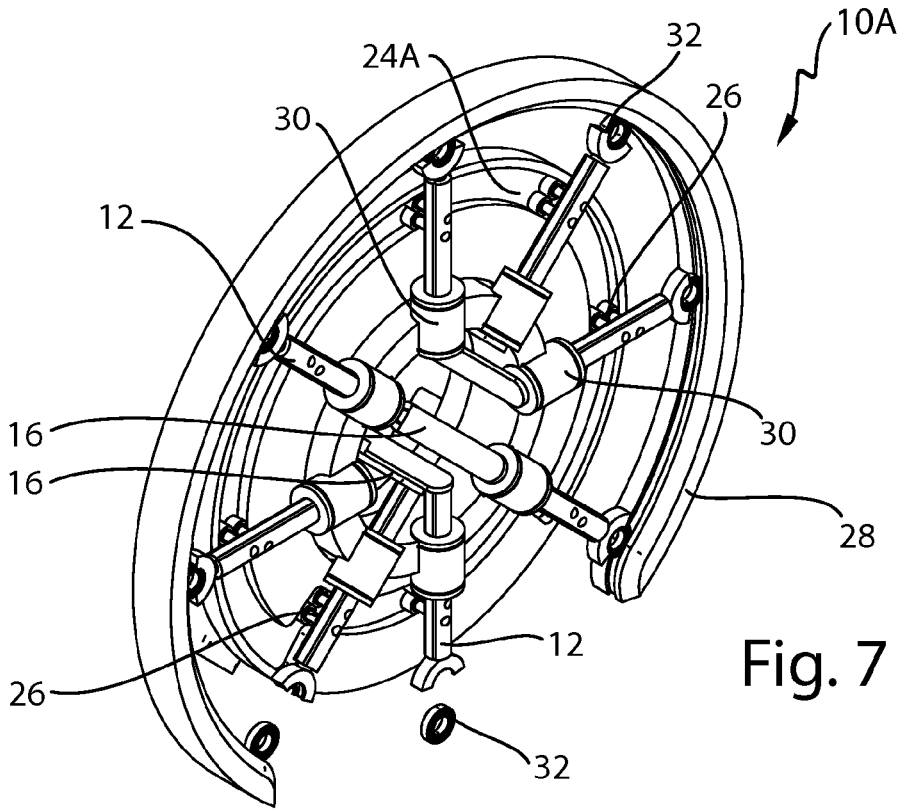
FIG. 7 is a perspective view of the left side of the exemplary mandrel cupping assembly of FIG. 5.
Figure 8:
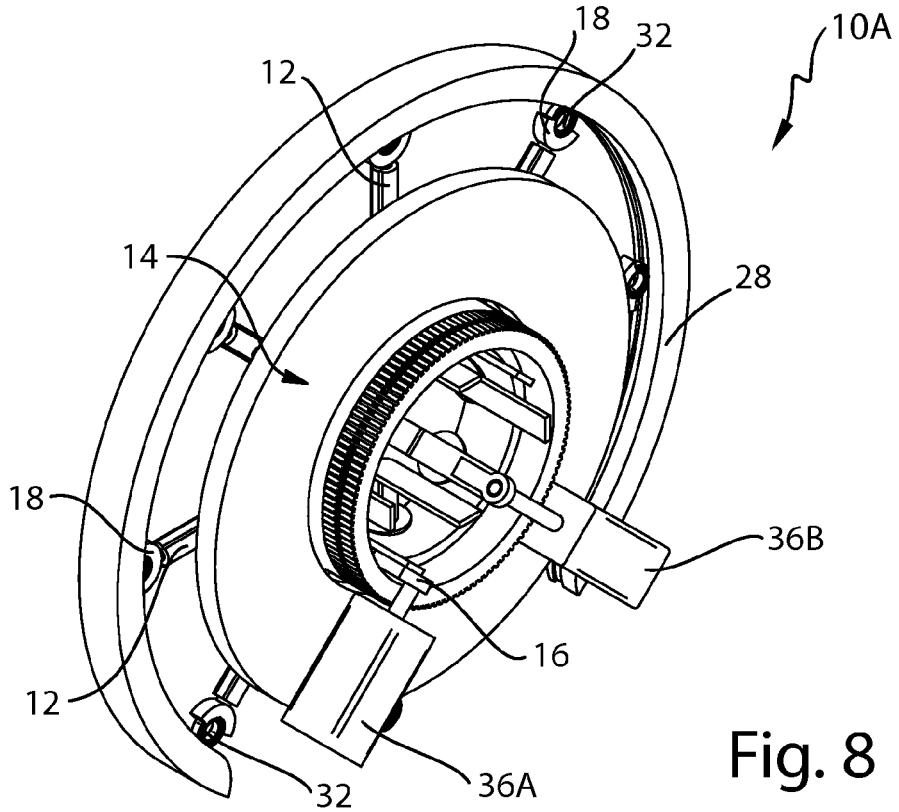
FIG. 8 is a perspective view of the external right side of the exemplary mandrel cupping assembly of FIG. 5.
Figure 9:
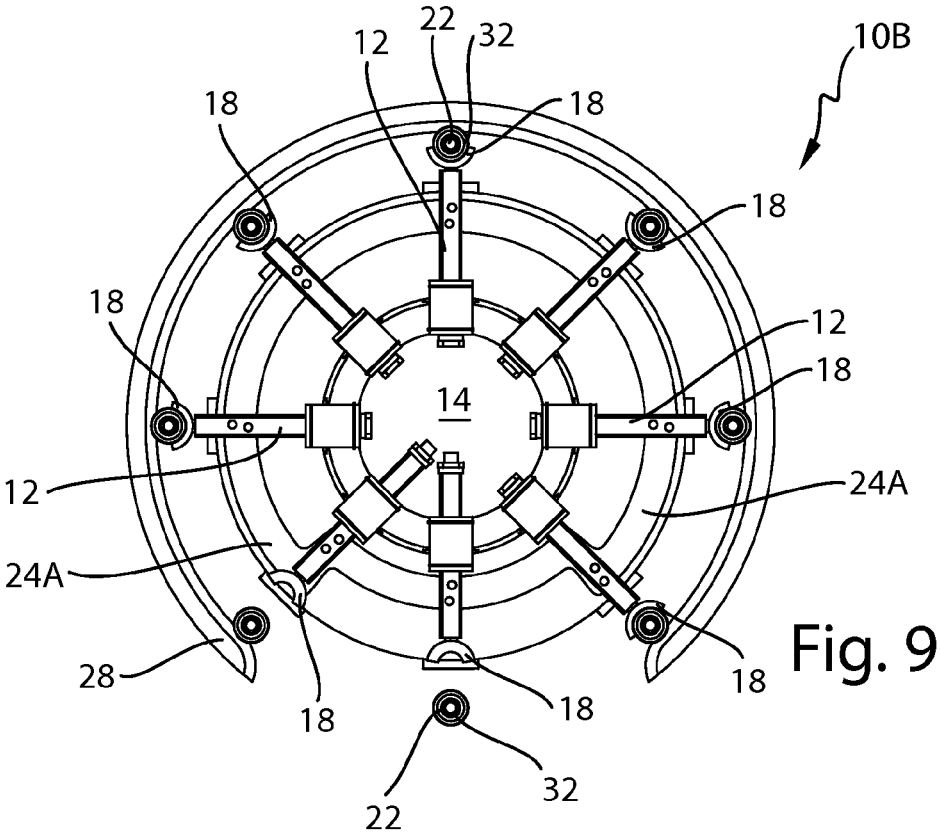
FIG. 9 is a planar end view of yet another exemplary mandrel cupping assembly of the present disclosure detailing both the open and closed positions.
Figure 10:
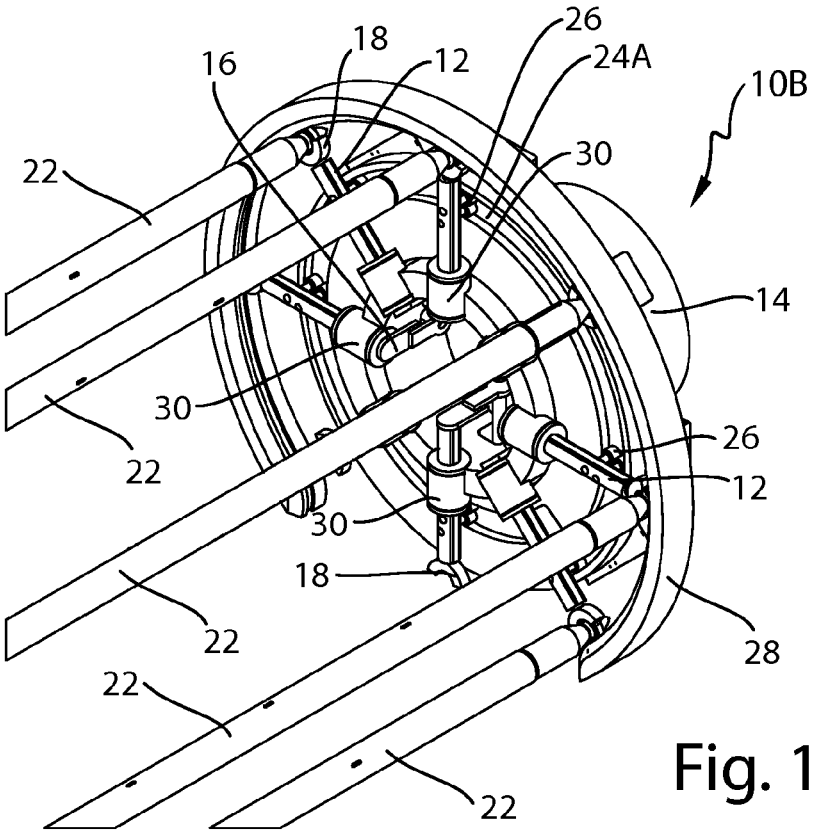
FIG. 10 is a perspective view of the right side of the exemplary mandrel cupping assembly of FIG. 9 showing mandrels cooperatively associated with mandrel cups.
Figure 11:
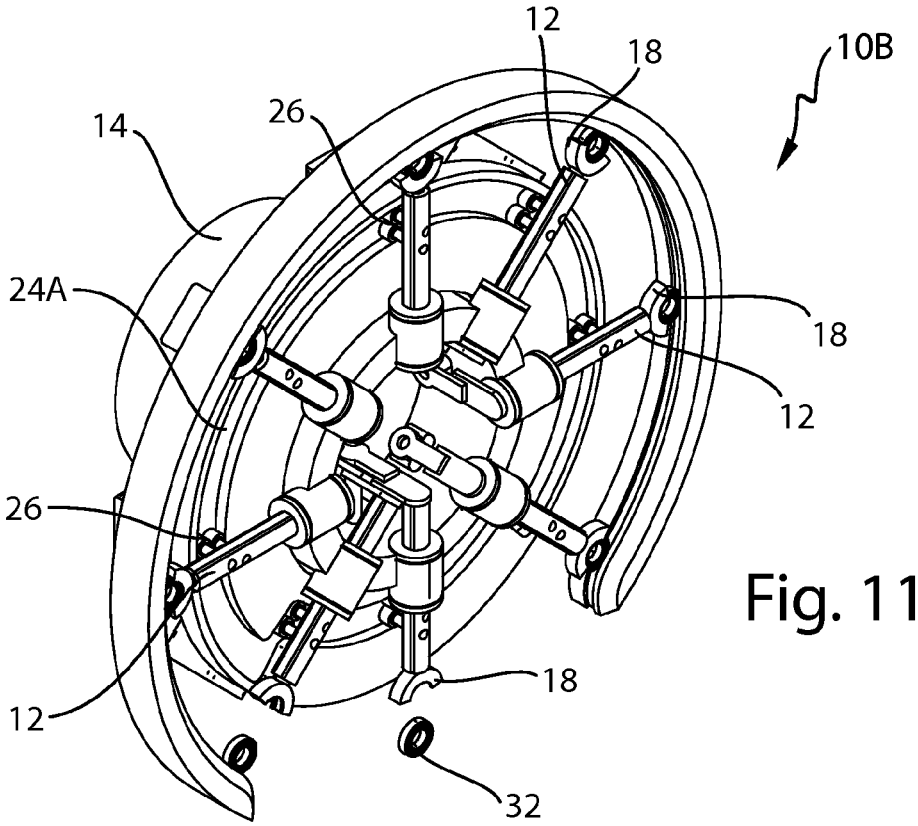
FIG. 11 is a perspective view of the left side of the exemplary mandrel cupping assembly of FIG. 9; and, FIG. 12 is a perspective view of the external right side of the exemplary mandrel cupping assembly of FIG. 9.
Figure 12:
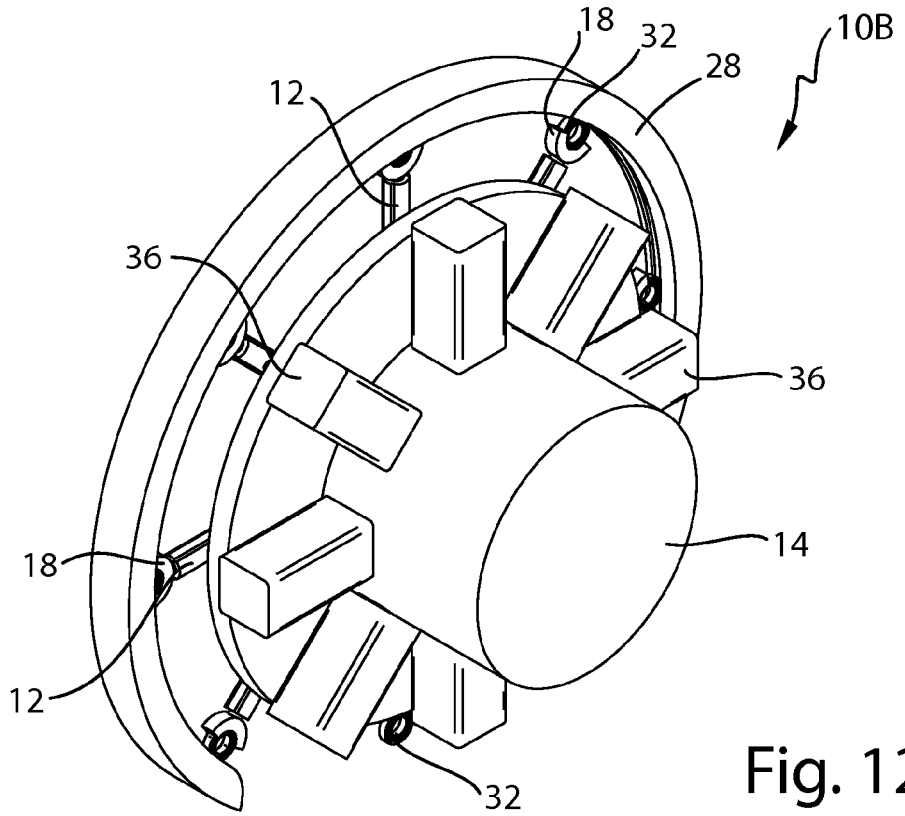

FIGS. 1-4 of the present disclosure depict various perspective and planar views of an exemplary cupping assembly 10. In the exemplary embodiment shown, the mandrel cupping assembly 10 is provided with mandrel cups 18 each mandrel cup 18 having cupping arms 12 disposed about a cupping spider 14 that are placed into contacting and un-contacting engagement with the free end of a web re-winding mandrel 22. In other words, a mandrel cup 18 releasably engages the unsupported end of a mandrel 22 and supports the mandrel 22 for rotation of the mandrel 22 about its own rotational axis as well as its rotation (i.e., orbit) about the axis of a turret assembly. In this embodiment, the mandrel cup 18 can be provided in an active configuration for movement (i.e., orbit) about the axis of cupping spider 14 once in mating engagement with a corresponding mandrel 22 cooperatively associated thereto.

In an alternative embodiment, the mandrel cup 18 can be provided in a passive configuration for movement (i.e., orbit) about cupping spider 14. In a passive configuration, it is envisioned that the inertia of a particular mandrel 22 due to its rotation about the axis of the turret assembly, once in mating engagement with a corresponding mandrel cup 18, will be sufficient to cause the corresponding mandrel cup 18 to orbit about cupping spider 14 in a cooperative manner coincident with the mandrel 22 cooperatively associated thereto.

In a preferred embodiment, a mandrel cup 18 is provided at the distal end of cupping arm 12. Cupping arm 12 is preferably provided with a cam follower 26 disposed intermediate the mandrel cup 18 and guide 30 of cupping assembly 10. The cam follower 26 is provided in a manner that allows for the cooperative engagement of cam follower 26 with a cam track 24 cam track 24 is intended to provide the geometry necessary for each respective mandrel cup 18 and associated hardware to rotate about the axis of cupping spider 14. Providing cam track 24 with such geometry can allow for the movement of cupping arm 12 in a direction orthogonal to the axis of cupping spider 14 to facilitate the engagement of mandrel cup 18 with a corresponding mandrel 22.

Guide 30 can facilitate the piston like movement of cupping arm 12 as the respective cam follower 26 disposed upon cupping arm 12 and disposed within cam track 24 is displaced radially relative to the axis of cupping assembly 10. To facilitate such piston like movement guide 30 can be formed to provide a sleeve or other low friction conduit to allow for the piston like movement of cupping arm 12.

As shown in FIG. 1, generally, a mandrel cup 18 disposed upon the distal end of cupping arm 12 engages the unsupported end of mandrel 22 and effectively encircles the unsupported end of mandrel 22 by engagement with outer ring 28. Outer ring 28 is provided to limit the movement of mandrel 22 in a direction radially away from the axis of cupping assembly 10 when mandrel cup 18 is effectively engaged with the unsupported end of mandrel 22. It is believed that the engagement of the unsupported end of mandrel 22 between mandrel cup 18 and outer ring 28 not only prevents the movement of mandrel 22 away from the axis of cupping assembly 10 but also seeks to reduce the vibration experienced by mandrel 22 as mandrel 22 orbit about the axis of cupping assembly 10 during the winding of a product about mandrel 22.

The mandrel cups 18 can be provided with detents for releasably engaging the unsupported end of a mandrel 22 and supporting the mandrel 22 for rotation of the mandrel 22 to about its own rotational axis as well as its rotation (i.e., orbit) about the axis of a turret assembly. The unsupported end of the mandrel 22 can be provided with a bearing 32 that is matingly engageable with the mandrel cup 18.

The exemplary cupping assembly 10 is generally presumed to be cooperatively engaged and mated with a corresponding web rewinding machine and the relevant portion of an exemplary, non-limiting embodiment of a turret assembly suitable for use as an automatic web rewinding machine. As would be appreciated by one of skill in the art, a plurality of rotatable core supporting mandrels 16 are carried in an indexable, orbital motion about the axis of the turret assembly as well as for rotation about their own respective axes. A turret assembly of the present disclosure generally provides a spider by which the respective mandrels 22 are carried and a shaft by which the spider is supported for rotation. The turret shaft projects a substantial distance in one direction from the spider and the mandrels 22 disposed thereupon project from the spider a somewhat smaller distance in the same direction. One of skill in the art will appreciate that since the rotatable connection between the spider and each of the long, relatively heavy mandrels 22 is near one end of the mandrel 22 and the other end of the mandrel 22 will be unsupported at times, the spider will typically be provided with two axially spaced apart bearings for each mandrel so that the cantilevered connection of the mandrel 22 with the spider can, by itself, hold the mandrel 22 reasonably steady. As will be appreciated by one of skill in the art, it is preferred that each mandrel 22 be provided equidistant from the axis of the turret and are uniformly spaced about that axis.

Each mandrel 22 can be driven to provide the required rotation in any conventional manner. One form of a mandrel drive apparatus can provide rotation of each mandrel 22 and its associated core disposed thereabout about the mandrel axis during movement of the mandrel 22 and core combination. The mandrel drive apparatus can provide winding of a web material upon the core supported on the mandrel 22 to form a log of web material wound around the core (a web wound core). This form of mandrel drive apparatus can provide center winding of the web material upon the cores (that is, by connecting the mandrel with a drive which rotates the mandrel 22 about its axis, so that the web material is pulled onto the core. The mandrel 22 can be provided with a profiled rotation that provides a constant rotational speed throughout the winding cycle. Alternatively, the mandrel 22 can be provided with a winding profile that provides a differential rotational speed throughout the winding cycle.

As one of skill in the art will appreciate, each mandrel 22 can be connected at its end adjacent to the spider (not shown) with a form of coaxial clutch that provides a disengageable to driving connection between the mandrel 22 and a coaxial sheave. Typically, the sheave is connected by means of a belt with a pulley and is rotatable on the turret shaft and in turn a belt drivingly connects the pulley with a motor which can be provided at a fixed location relative to the frame of the turret assembly. Such assemblies are described in U.S. Pat. No. 4,280,669.

Further, one of skill in the art will appreciate that a turret assembly having a turret (not shown) is typically indexingly rotated to carry each of the mandrels 22 to each of a succession of fixed stations at each of which the mandrel dwells for a time during the performance of an operation distinctive to the particular station. The arrangement of the stations, the operation or operations at each, and the apparatus provided at the several stations for the performance of their function are all generally known to those of skill in the art familiar with web rewinding machines.

In one exemplary, but non-limiting embodiment, each mandrel 22 can be provided with a toothed mandrel drive pulley and a smooth surfaced, freewheeling idler pulley, both disposed near the at its end adjacent to the spider. The positions of the drive pulley and idler pulley alternate on every other mandrel 22, so that alternate mandrels 22 are driven by their respective mandrel drive belts. For instance, when a mandrel drive belt engages the mandrel drive pulley on its associated mandrel 22, the mandrel drive belt can ride over the smooth surface of the idler pulley on that same mandrel 22, so that only the respective drive motor provides rotation of that mandrel 6 about its axis. Similarly, when the mandrel drive belt engages the mandrel drive pulley on an adjacent mandrel 22, the mandrel drive belt can ride over the smooth surface of the idler pulley on that respective mandrel 22, so that only that drive motor provides rotation of the mandrel about its axis. Accordingly, each drive pulley on an associated mandrel 22 engages one of the belts to transfer torque to the mandrel, and the idler pulley engages the other of the belts, but does not transfer torque from the drive belt to the mandrel.

As would also be understood by one of skill in the art, a length of tubular core stock from a supply thereof is advanced axially by known mechanisms to be loaded onto a particular mandrel 22. Typically, a mandrel 22 has a conical or "bullet"- shaped nose free end portion to assist in guidance of the cores into a coaxial relationship thereto.

Similarly, after the winding of a web material into a wound product upon a core disposed upon an associated mandrel 22, it was found that a generally conventional mandrel unloading mechanism can provide the individual rolls of wound product to be stripped off a particular mandrel 22 at an unload station. In one embodiment, the unloading mechanism may comprise an endless belt arranged to have a long, straight stretch which extends parallel to the mandrel 22 at the unloading station at a small distance to one side of that mandrel 22. A pusher can be secured to the belt and can project laterally therefrom to engage from behind a log of wound product and drive it off the mandrel 22 as the pusher moves away from the spider along a straight stretch.

Alternatively, a core stripping apparatus can be positioned along the unload station. An exemplary core stripping apparatus can comprise a driven core stripping component, such as an endless conveyor belt. The conveyor belt preferably carries a plurality of flights spaced apart on the conveyor belt. Each flight can engage the end of a log supported on a mandrel 22 as the mandrel 22 enters the unload station.

A flighted conveyor belt can be angled with respect to a respective mandrel 22 axis as the mandrels 22 are carried along a generally straight line portion of the core unload station so that the flights engage each log disposed about a mandrel 16 with a first velocity component generally parallel to the mandrel 22 axis, and a second velocity component generally parallel to the straight line portion of the unload station. Once the log is stripped from the respective mandrel 22, the mandrel 22 can be carried along the closed mandrel path to the core loading station to receive another core.

As shown generally in FIGS. 1-4, one of skill in the art will recognize that during both unloading and loading of a mandrel 22, the end of a mandrel 22 that is remote from the spider must be unsupported. However, as the mandrel 22 moves through the portion of its orbit about the axis of the turret assembly that takes it from the loading station around to an unloading station, its free end portion is preferably supported by a mandrel cup 18 of cupping assembly 10 having mandrel cups 18 disposed upon cupping arms 12 is disposed about a cupping spider 14 that are placed into contacting and uncontacting engagement with the free end of the mandrel 22.

In other words, a mandrel cup 18 releasably engages the unsupported end of a mandrel 22 and supports the mandrel 22 for rotation of the mandrel 22 about its own rotational axis as well as its rotation (i.e., orbit) about the axis of the turret assembly. In this embodiment, the mandrel cup 18 is in an active configuration for coincident movement with cupping spider 14. In an active configuration, it is envisioned that the cupping spider 14 will provide the inertia necessary to provide cooperative movement of the respective mandrel cup 18 with the mandrel 22 associated thereto.

However, one of skill in the art will recognize that mandrel cup 18 can also be provided in a passive configuration relative to a particular mandrel 22 for orbital motion about cupping spider 14. Movement in this passive configuration can be due to its rotation about the axis of the turret assembly once in mating engagement with a corresponding mandrel cup 18. It is believed that this movement can be sufficient to cause the corresponding mandrel cup 18 and cupping arm 12 to orbit about cupping spider 14 while disposed in, or otherwise cooperatively engaged with cam track 24 or any other groove, track, or other means in a cooperative manner coincident with the mandrel 22 cooperatively associated thereto. In such a passive configuration, it is envisioned that the inertia of a particular mandrel 22 due to its rotation about the axis of the turret assembly, once in mating engagement with a corresponding mandrel cup 18, will be sufficient to cause the corresponding mandrel cup 18 to orbit about cupping spider 14 in a cooperative manner coincident with the mandrel 22 cooperatively associated thereto.

In a preferred embodiment, a particular mandrel cup 18 is cooperatively associated with each mandrel 22. A mandrel cup 18 of mandrel cupping assembly 10 releasably engages the unsupported end of a mandrel 16 against guide 30 intermediate the core loading segment and the core stripping segment of the closed mandrel path as the mandrels 22 are driven around the turret assembly axis by the rotating turret assembly.

In certain embodiments, when a turret assembly comprises four mandrels 22, naturally there will be four mandrel cups 18/cupping arms 12 disposed radially about cupping spider 14—each mandrel cup 18 providing cooperative engagement with each respective mandrel 22. Similarly, a turret assembly having six, eight, or ten mandrels 22 disposed thereabout, a cupping assembly 10 will have respectively six, eight, or ten respective mandrel cups 18/cupping arms 12 disposed radially about cupping spider 14 to provide cooperative engagement with each respective mandrel 22.

In any regard, each mandrel 22 associated with the turret assembly is provided with a corresponding mandrel cup 18/cupping arm 12 that is disposed radially about cupping spider 14 of cupping assembly 10. Each mandrel cup 18 and associated cupping arm 12 preferably orbits with, or about, cupping spider 14 in a cooperative motion with a respective mandrel 22 (depending upon either active or passive movement about cupping spider 14).

In either an active or passive configuration, such rotary motion can carry a respective mandrel cup 18/cupping arm 12 to rotate about or orbit about the axis of cupping assembly 14 while disposed/cooperatively engaged in cam track 24 and/or outer ring guide 34. As used herein a "track" should be broadly construed to provide a path or line for travel or motion for sliding or rolling a part or parts. As such, a "track" or "guide" may include any device, apparatus, or assembly that prevents the unwanted movement from one portion of a device or assembly to to another. Non-limiting examples of various tracks may include a race, a cam, a trace, a channel, groove, a rail, or the like all of which are used interchangeably and combineably herein without limitation.

It should be noted that cupping assembly 10 can be capable of providing the mandrel cup 18 in a "tensioned" operative position in which the respective mandrel cup 18 and associated cupping arm 12 supportingly engage the free end portion of a cooperatively associated mandrel 22 and is positioned relative to cupping spider 14 in a position that provides a tension to mandrel 22. This additional motion was surprisingly found to assist in the reduction of vibrations in the web winding equipment during operation.

Generally, cupping arms 12 remain in a radially "up-right" position relative to cupping spider 14 when in contacting and non-contacting engagement with a respective mandrel 22. In a preferred embodiment, when mandrel cup 18 is not in contacting engagement with a respective mandrel 22, cupping arms 12 remains in a radially up-right position relative to cupping spider 14 and rotates radially with or about cupping spider 14 depending on the active/passive condition of cupping assembly 10. Rotation of cupping arms 12 with or about cupping spider 14 causes the respective cupping arms 12 to move to a position radially away from mandrel 16 in a direction that is generally oriented toward the surface of cupping spider 14. In other words cupping arm 12 and the associated mandrel cup 18 is drawn though guide 30 in a direction orthogonal to the axis of cupping assembly 10. In this position the cupping arm 12 and the associated mandrel cup 18 are preferably removed from the region proximate to mandrel 22 thereby allowing mandrel 22 to remain unsupported and allow for the removal of any product wound thereabout.

Coincident with the removal of the mandrel cup 18 from the end of mandrel 22 any tension applied by mandrel cup 18 upon mandrel 22 can be released by the movement of mandrel cup 18 in a direction parallel to the longitudinal axis of cupping spider 14 and/or the longitudinal axis of mandrel 22. In a preferred embodiment the mandrel cup 18 is moved inward (i.e., toward mandrel 22 in a direction parallel to the axis of mandrel 22) relative to mandrel 22 along the surface of cupping spider 14 and then cupping arms 12 are rotated about cupping spider 14 in a direction away from mandrel 22 to enable removal of any material wound about mandrel 22 during processing.

Each mandrel cup 18 can be further provided with a bearing race or ring at an end distal from cupping spider 14 and preferably comprises a bearing socket in which the generally conical end portion of the mandrel 22 is receivable. The ring can provide locking engagement with the unsupported end of mandrel 22. Such locking engagement can be provided through the use of to locking pins, a 'snap-lock', magnets, gears, deformable rings, and the like. In any regard, it is preferred that the unsupported end of a corresponding mandrel 22 be capable of rotation within the engaged portion of mandrel cup 18 while not being able to withdraw from the 'locked' position while the mandrel cup 18 is in a closed position relative to mandrel 22.

In an alternative embodiment shown in FIGS. 5-8 of the present disclosure depict various perspective and planar views of an alternative embodiment of an exemplary cupping assembly 10A. It should be readily understood by one of skill in the art that the mandrel cupping assembly 10A would naturally be provided with a plurality of mandrel cups 18. In the exemplary embodiment shown, the mandrel cupping assembly 10A is generally provided with mandrel cups 18 having cupping arms 12 disposed about a cupping spider 14 that are placed into contacting and un-contacting engagement with the free end of a web re-winding mandrel 22. In other words, a mandrel cup and supports the mandrel 22 for rotation of the mandrel 22 about its own rotational axis as well as its rotation (i.e., orbit) about the axis of a turret assembly.

In this embodiment, the mandrel cup 18 can be provided in an active configuration (i.e., self-propelled movement corresponding to the movement of mandrel 22) for movement (i.e., orbit) about the axis of cupping spider 14 once in mating engagement with a corresponding mandrel 22 cooperatively associated thereto. Alternatively, the mandrel cup 18 can be provided in a passive configuration for movement (i.e., orbit) about cupping spider 14. In a passive configuration, it is envisioned that the inertia of a particular mandrel 22 due to its rotation about the axis of the turret assembly, once in mating engagement with a corresponding mandrel cup 18, will be sufficient to cause the corresponding mandrel cup 18 to orbit about cupping spider 14 in a cooperative manner coincident with the mandrel 22 cooperatively associated thereto.

The disposition of each cupping arm 12 and associated mandrel cup 18 into contacting or non-contacting engagement with a respective mandrel 16 is defined by cupping actuators 36A, 36B and cam track 24A. In the embodiment shown in FIGS. 5-8, the cupping assembly 10 of the present disclosure is configured to require the use of two cupping actuators 36A, 36B to provide engagement and disengagement of the respective cupping arm 12 and associated mandrel cup 18 with the mandrel 22 cooperatively associated thereto. A first cupping actuator 36A provides movement of each cupping arm into a hold-closed position relative to a respective mandrel 22 sequentially. A second cupping actuator 36B provides movement of each cupping arm into a hold-open position relative to a respective mandrel 22 sequentially. In other words the first cupping actuator 36A engages a first respective cupping arm 12/mandrel cup 18 with a first mandrel 22 and then engages a second respective cupping arm 12/mandrel cup 18 with a second mandrel 22, and so on. The second cupping actuator 36B disengages a first respective cupping arm 12/mandrel cup 18 from the first mandrel 22 after use and then disengages the second respective cupping arm 12/mandrel cup 18 from the second mandrel 22 after use, and so on.

In any case cupping actuators 36A, 36B are provided to transfer each respective cupping arm 12 and associated mandrel cup 18 from a hold-open position to a hold-closed position. Similarly cupping actuators 36A, 36B are designed to be utilized to transfer each respective cupping arm 12/mandrel cup 18 from the hold-closed position to the hold-open position. In a preferred but non-limiting embodiment, the respective cupping actuators 36A, 36B can push/pull on a linkage (lift arm 16) cooperatively associated with cupping actuators 36A, 36B and the respective cupping arm 12 to provide transfer from the hold-open position to the hold-closed position or from the hold-close position to the hold-open position respectively. In any regard the hold-open position preferably provides a region suitable for the removal of the respective cupping arm 12, mandrel cup 18 and associated equipment from the respective mandrel 22 and to provide the clearance necessary to facilitate removal of the material (e.g., core, core and material, etc.) disposed about mandrel 22.

One of skill in the art will appreciate that the respective cupping arm 12 and mandrel cup 18 to be in a fully retracted position before the cupping arm 12/mandrel cup 18 proceed past the position where the cupping actuators 36A, 36B engaged the cupping arm 12. This engagement causes cupping arms 12 to be positioned in a hold-closed position and thus in contacting engagement with the unsupported end of a respective mandrel 22.

In a preferred embodiment, the cupping arms 12/mandrel cup 18 eventually reaches a dwell position where the cupping arms 12 are fully retracted from the mandrel 22. In such a dwell position, a core can be loaded onto the respective mandrel 22 then the cupping arm 12 and mandrel cup 18 can be directed inwardly toward the open end of the mandrel 22 in order to close the mandrel cup 18 against outer ring 28 disposing the respective mandrel 22 and bearing 32 (disposed about the surface of mandrel 22) therebetween. The geometry and/or location of the hold-open position is preferably designed to allow the turret assembly to cup during dwell, turret index, or any combination of the two. Practically, it was found that this design allows more time to load a core onto a respective mandrel 22 and also facilitates higher turret assembly turnover speeds. The cupping arms 12 and mandrel cup 18 can begin to retract once the mandrel cup 18 reaches the clear-out position. In this position, it is preferred that the cupping arms 12 of mandrel cup 18 in a fully retracted position before the next incoming mandrel cup 22 approaches a clear-in position.

One of skill in the art will readily appreciate the fact that using only two cupping actuators 36A, 36B greatly reduces the need for having a respective activation device for each cupping arm 12/mandrel cup 18 that may be associated with a cupping assembly of the prior art. Further, it will be readily appreciated by one of skill in the art as clearly advantageous in having such a cupping assembly 10A having only two actuating devices (e.g., cupping actuators 36A, 36B) in that such a system can allow cupping and un-cupping actions to occur at virtually any point of the rotation of turret assembly as well as the respective cupping arms 12/mandrel cups 18 orbiting about cupping spider 14. This can include, but clearly not be limited to, turret assembly dwell, turret assembly index, or any combination of the two. This is clearly advantageous over conventional cam track systems that require cupping and un-cupping actions to occur only while the turret is in motion. Clearly, one of skill in the art will appreciate that the system of the present invention provides less complexity by allowing increased product turn-over rates, reduced maintenance and repair times, as well as reduced maintenance and repair costs.

In the alternative exemplary but non-limiting embodiment shown in FIGS. 9-12, the cupping assembly 10B of the present disclosure can be configured to associate a cupping actuator 36 with each cupping arm 12/mandrel cup 18 in order to provide both engagement and disengagement of respective cupping arms 12/mandrel cup 18 with a mandrel 16 cooperatively associated thereto. In this embodiment, the cupping actuators 36 and any associated ancillary equipment of the present cupping assembly 10 may rotate with a respective mandrel cup 28.

In this embodiment, the cupping arm 12/mandrel cup 18 can be designed so that a cupping actuator 36 associated thereto transfers each respective cupping arm 12/mandrel cup 18 from the hold-open position to the hold-closed position as well as from the hold-closed position to the hold-open position. In a preferred but non-limiting embodiment, the respective cupping/un-cupping actuator 36 can push/pull on a linkage cooperatively associated with the respective cupping arm 12. Alternatively, the respective cupping/un-cupping actuator 36 can push/pull directly upon cupping arms 12 upon engagement of the cupping actuator/un-cupping actuator 36 directly upon cupping arms 12. The hold-open position preferably provides a region suitable for the removal of the respective cupping arms 12/mandrel cup 18 from the respective mandrel 22 and to provide the clearance necessary to facilitate removal of the material (e.g., core, core and material, etc.) disposed upon or about mandrel 22.

As with the other embodiments discussed herein, one of skill in the art will appreciate that the respective cupping arms 12/mandrel cup 18 should be in a fully retracted position before the cupping arms 12/mandrel cup 18 proceed past the position where the actuators 30 engages the cupping arms 12/mandrel cup 18. This engagement causes cupping arms 12/mandrel cup 18 to be positioned in hold-closed position and thus in contacting engagement with the unsupported end of a respective mandrel 22.

In any regard, actuators 36 (cupping, un-cupping, or otherwise) can be provided as linear motors. However, one of skill in the art will understand that it would also be possible to provide an embodiment of the cupping assembly 10 where the actuators 36 are provided as a four-port, two-position valve having an axially slideable valve element. In such an embodiment, actuators 36 can be operated by the use of compressed air or any other fluid suitable for use in such constructions.

An unloading mechanism (not shown) can be started as soon as the mandrel cup 18 associated with the mandrel 16 having wound product disposed thereon, has reached the start of hold open position. Starting of the unloading mechanism can be coordinated with cupping arms 12/mandrel cup 18 opening in any of several manners. For example, a start signal can be issued after a predetermined delay interval followed by the end of indexing motion. Alternatively, the unloading mechanism can be stopped at the end of each unloading operation in such a position that when restarted for the next operation, the pusher moves substantial distance before coming into engagement with wound product disposed about a mandrel 16 forming the outgoing log. In such a case, the unloading mechanism can be started in operation simultaneously with delivery of the opening input to the unloading station.

Once the cupping arms 12/mandrel cup 18 is engaged with the unsupported end of the mandrel 22 after loading of a core upon mandrel 22 in the loading position, it remains in that position until the turret assembly indexes to carry the mandrel 22 out of the loading position. Furthermore, as the mandrel 22 moves away from the loading position and its associated cupping arms 12/mandrel cup 18 is engaged into the hold-closed position, the cupping arms 12/mandrel cup 18 is maintained in its engaged position with the now supported end of mandrel 22. The turret assembly then indexes the mandrel 22 and associated cupping arms 12/mandrel cup 18 about its longitudinal axis until web product is contactingly engaged with the core disposed upon the mandrel 22. At this point, mandrel 22 is spun up (i.e., rotational inertia is imparted) and as discussed supra coincides with the winding of a web material about the core disposed about mandrel 22 to form a wound product.

Upon reaching the unloading position disposed proximate to the start of hold-open position, the actuator(s) 36 can then be engaged to cupping arms 12/mandrel cup 18 (with or without the use of a chucking lever) to retract the cupping arms 12/mandrel cup 18 from to contacting engagement with a corresponding mandrel 22 and positioning the cupping arms 12/mandrel cup 18 into the hold-open position. Positioning of the cupping arms 12/mandrel cup 18 into the hold-open position then facilitates the mandrel 22 having wound product disposed thereon to be removed from mandrel 22. The cupping arms 12/mandrel cup 18 remain open in order to clear any required supports. The mandrel cup 18 and cupping arms 12 can then freely orbit about the axis of cupping assembly 10 (or orbit with cupping assembly 10) in the hold-open position in preparation for movement of the next mandrel 16 into the unloading position and egress of ensuing wound product.

By reference, a core may be started onto the mandrel 22 at the loading position by means of a core loading apparatus as would be known by those of skill in the art. After the core has run onto the mandrel 22 a known distance, the core can then be engaged by a rotating loading wheel known to those of skill in the art that initially cooperates with the core loading apparatus and moving the core onto the mandrel 22 but which takes over the propulsion of the core in the last part of movement onto the mandrel 22.

Further, as would be known by those of skill in the art, when a core is properly positioned on the mandrel 22, its front end preferably engages in an abutment located near the spider supporting the mandrels 22. After it engages the abutment, the core cannot be advanced any further by the rotating core loading wheel which would then merely slip relative to the core. At about the time that the core engages the abutment, its front end portion moves under an arm that typically comprises a core detector. Such an apparatus may comprise a spring arm having a free end portion that is biased towards contacting engagement with the mandrel 22 at the loading station and a properly loaded core intervenes between the associated spring arm and the mandrel 22 to break contact between them and thus open an electric signal circuit through the spring arm.

As would be understood by those of skill in the art, interruption of the circuit typically comprising an output signifying core presence can cause rotation of the associated core loading wheel to be stopped and engagement of a mandrel cup 18 upon the mandrel 22 by operation of the cupping actuator(s) 30 causing the cupping arms 12/mandrel cup 18 to engage the unsupported end of a mandrel 22 having the core disposed thereupon. Such a core presence signal can also be issued to a PCD, PLC, or other synchronizing mechanism for the apparatus and its issuance is in any case a condition or the condition for retraction of the cupping arms 12/mandrel cup 18 at the appropriate position. Such retraction, as pointed out above, constitutes a closing input to the control element for the cupping arms 12/mandrel cup 18 to be positioned to back into contacting engagement with its respective mandrel 22. Thus, the cupping arms 12/mandrel cup 18 is in the closed position only if and when a core is present on the mandrel 22 at the loading station and before the mandrel 22 begins to move out of that station.

It should be realized by one of skill in the art that engagement of the cupping arms 12/mandrel cup 18 upon the mandrel 22 could also occur just prior to any core presence signal being detected. It should be recognized that the core should be clear of the cupping arms 12/mandrel cup 18 before the cupping arms 12/mandrel cup 18 are moved toward the mandrel 16.

In a preferred embodiment, since the cupping arms 12/mandrel cup 18 can be moved into the closed position where contacting engagement occurs between the cupping arms 12/mandrel cup 18 and the respective mandrel 22 and likely after the mandrel 22 has been subjected to vibration dampening, it is unlikely that the conical end portion typically associated with the mandrel 22 will fail to seat in the mandrel cup 18. However, in the event of such a failure, the actuator(s) 36 can be merely programmed to stop short of its limit position where the mandrel cup 18 is closed, thus eliminating damage that can result because the mandrel cup 18 will be urged past the stationary mandrel 22 under yielding pressure from mandrel cup 18.

Any dimensions and values disclosed herein are not to be understood as being strictly limited to the exact dimension and values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A mandrel cupping assembly for releasably engaging unsupported ends of a plurality of mandrels disposed on a web winding turret assembly having a web winding turret assembly axis, each of said plurality of mandrels extending generally parallel to said web winding turret assembly axis, each of said mandrels being driven in a closed mandrel path about said web winding turret assembly axis, said mandrel cupping assembly comprising:

a cupping spider having a cupping spider central axis;

a mandrel cup and cupping arm cooperatively associated with each mandrel of said plurality of mandrels, each of said mandrel cups and cupping arms being disposed radially about said cupping spider;

an outer ring guide disposed coaxially about and formed in a surface of an outer ring;

wherein each of said mandrel cups is carried in a radial orbital path about said cupping spider central axis and releasably engages said unsupported end of said mandrel against said outer ring guide in a hold-closed position and disengages from said mandrel and said outer ring guide in a hold-open position; and, an actuator cooperatively associated with each of said cupping arms, each of said actuators being capable of disposing said cupping arm cooperatively associated thereto from said hold-open position to said hold-closed position.

2. The mandrel cupping assembly of claim 1 wherein disposing said cupping arm from said hold-open position to said hold-closed position further comprises engaging said mandrel between said mandrel cup cooperatively associated thereto and said outer ring guide.

3. The mandrel cupping assembly of claim 2 wherein said actuator is capable of disposing said cupping arm cooperatively associated thereto from said hold-closed position to said hold-open position.

4. The mandrel cupping assembly of claim 3 wherein disposing each of said mandrel cups and cupping arms from said hold-closed position to said hold-open position further comprises disengaging said mandrel from between said mandrel cup cooperatively associated thereto and said outer ring guide.

5. The mandrel cupping assembly of claim 1 wherein said actuator is capable of disposing said cupping arm cooperatively associated thereto from said hold-closed position to said hold-open position.

6. The mandrel cupping assembly of claim 5 wherein disposing said mandrel cup from said hold-closed position to said hold-open position further comprises disengaging said mandrel from between said mandrel cup cooperatively associated thereto and said outer ring guide.

7. The mandrel cupping assembly of claim 1 wherein said mandrel cup and cupping arm are indexably rotatable about said radial path.

8. The mandrel cupping assembly of claim 7 wherein said mandrel cup and cupping arm are manually advanceable from a first position to a second position about said radial path.

9. The mandrel cupping assembly of claim 1 wherein said cupping arm further comprises a linkage for cooperative engagement with said actuator.

10. The mandrel cupping assembly of claim 1 wherein said mandrel cup and cupping arm cooperatively associated with each mandrel dwells in each of a plurality of positions about said cupping arm turret.

11. The mandrel cupping assembly of claim 10 wherein one of said plurality of positions provides for disposition of a core upon one of said plurality of mandrels when said mandrel cup and cupping is disposed in said hold-open position.

12. The mandrel cupping assembly of claim 11 wherein a second of said plurality of positions provides for disposition of a web substrate upon said core when said mandrel cup and cupping is disposed in said hold-closed position.

13. The mandrel cupping assembly of claim 12 wherein at least one of said plurality of positions provides for removal of said core and said web substrate disposed thereabout when said mandrel cup and cupping is disposed in said hold-open position.

14. The mandrel cupping assembly of claim 1 wherein each of said mandrel cups comprises a detent configured to partially encircle said unsupported end of said mandrel cooperatively associated thereto.

15. The mandrel cupping assembly of claim 14 wherein said outer ring guide and each of said mandrel cups comprises a cooperative detent configured to partially encircle said unsupported end of said mandrel cooperatively associated thereto when said outer ring guide, said mandrel cup, and said mandrel cooperatively associated thereto are cooperatively engaged.

16. The mandrel cupping assembly of claim 15 wherein said unsupported end of said mandrel further comprises a bearing disposed thereabout, said bearing being cooperatively engageable with said outer ring guide and said mandrel cup when said outer ring guide, said mandrel cup, and said mandrel cooperatively associated thereto are cooperatively engaged.

* * * * *